US009212423B2

(12) United States Patent
Tachiki et al.

(10) Patent No.: US 9,212,423 B2
(45) **Date of Patent: *Dec. 15, 2015**

(54) STEEL SHEET FOR CONTAINER USE WITH EXCELLENT ORGANIC FILM PERFORMANCE AND METHOD OF PRODUCTION OF SAME

(75) Inventors: Akira Tachiki, Tokyo (JP); Shigeru Hirano, Tokyo (JP); Hirokazu Yokoya, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 309 days.

This patent is subject to a terminal disclaimer.

(21) Appl. No.: 13/261,017

(22) PCT Filed: Jun. 4, 2010

(86) PCT No.: PCT/JP2010/059891

§ 371 (c)(1),
(2), (4) Date: Nov. 14, 2011

(87) PCT Pub. No.: WO2010/140711

PCT Pub. Date: Dec. 9, 2010

(65) Prior Publication Data

US 2012/0064369 A1 Mar. 15, 2012

(30) Foreign Application Priority Data

Jun. 4, 2009 (JP) ..... 2009-134889

(51) Int. Cl.

| | |
|---|---|
| ***B32B 15/01*** | (2006.01) |
| ***B05D 7/14*** | (2006.01) |
| ***B05D 3/00*** | (2006.01) |
| ***B05D 1/18*** | (2006.01) |
| ***C25D 5/48*** | (2006.01) |
| ***C23C 22/10*** | (2006.01) |
| ***C23C 22/68*** | (2006.01) |
| ***C25D 9/10*** | (2006.01) |

(52) U.S. Cl.

CPC ..... *C23C 22/10* (2013.01); *C23C 22/68* (2013.01); *C25D 5/48* (2013.01); *C25D 9/10* (2013.01); *Y10T 428/12972* (2015.01)

(58) Field of Classification Search

None

See application file for complete search history.

(56) References Cited

U.S. PATENT DOCUMENTS

| | | | | |
|---|---|---|---|---|
| 8,133,594 | B2 * | 3/2012 | Tachiki et al. | 428/633 |
| 8,753,754 | B2 * | 6/2014 | Hirano et al. | 428/632 |
| 2005/0175798 | A1 * | 8/2005 | Kurokawa et al. | 428/34.1 |
| 2009/0239093 | A1 * | 9/2009 | Inbe et al. | 428/612 |
| 2010/0119867 | A1 * | 5/2010 | Date | 428/633 |
| 2012/0183753 | A1 * | 7/2012 | Hirano et al. | 428/212 |
| 2013/0143066 | A1 * | 6/2013 | Hirano et al. | 428/632 |

FOREIGN PATENT DOCUMENTS

| | | | | |
|---|---|---|---|---|
| EP | 2 180 084 | | 4/2010 | |
| JP | 60-168643 | | 9/1985 | |
| JP | 60-170532 | | 9/1985 | |
| JP | 02-263523 | | 10/1990 | |
| JP | 03-032835 | | 2/1991 | |
| JP | 3-236954 | | 10/1991 | |
| JP | 05-111979 | | 5/1993 | |
| JP | 05-124648 | | 5/1993 | |
| JP | 05-147181 | | 6/1993 | |
| JP | 2005-325402 | | 11/2005 | |
| JP | 2006-009047 | | 1/2006 | |
| JP | 2009-001854 | | 1/2009 | |
| JP | 2009001854 | * | 1/2009 | |
| JP | 2009-068108 | | 4/2009 | |
| JP | 2009256726 | * | 11/2009 | C25D 9/08 |
| WO | WO2007100017 | * | 9/2007 | |

OTHER PUBLICATIONS

JP20091854_MT Jan. 2009.*

International Search Report dated Jul. 27, 2010 issued in corresponding PCT Application No. PCT/JP2010/059891.

* cited by examiner

*Primary Examiner* — Vera Katz

(74) *Attorney, Agent, or Firm* — Kenyon & Kenyon LLP

(57) ABSTRACT

Steel sheet for container use with excellent canmaking workability and with excellent drawability and ironability, weldability, corrosion resistance, coating adhesion, film adhesion, and wettability characterized in that a surface of the steel sheet has a Zr film which contains, by amount of metal Zr, 1 to 100 mg/m$^2$ of Zr oxides.

12 Claims, No Drawings

STEEL SHEET FOR CONTAINER USE WITH EXCELLENT ORGANIC FILM PERFORMANCE AND METHOD OF PRODUCTION OF SAME

This application is a national stage application of International Application No. PCT/JP2010/059891, filed 4 Jun. 2010, which claims priority to Japanese Application Nos. 2009-134889, filed 4 Jun. 2009 which is incorporated by reference in its entirety.

TECHNICAL FIELD

The present invention relates to steel sheet for container use which is used as a material for canmaking, in particular, sheet with excellent drawability and ironability, weldability, corrosion resistance, coating adhesion, wettability, film adhesion, and other organic film performance and a method of production of the same.

BACKGROUND ART

The metal containers which are used for beverages and foods are roughly divided into two-piece cans and three-piece cans.

In the process of production of two-piece cans such as DI cans, the can is drawn and ironed, then the inside of the can is coated and the outside of the can is coated and printed on.

In the process of production of three-piece cans, the surface corresponding to the inside surface of the can is coated, the surface corresponding to the outside of the can is printed, then the can body is welded.

In each type of can, a coating process is essential before and after the canmaking. For the coating, a solvent-based or water-based coating is used, then the coating is baked on.

In the coating process, the waste solvent derived from the coating is discharged as industrial waste. Exhaust gas (mainly carbon dioxide gas) is released into the air. In recent years, efforts have been made to reduce the industrial waste and exhaust gas for the purpose of protecting the global environment.

Among these efforts, the technique of laminating a film to take the place of coating has come into attention and has been rapidly spreading.

In two-piece cans, numerous methods of production of cans which laminate films to make the cans and inventions relating to these have been devised (for example, PLT's 1 to 4).

As inventions relating to three-piece cans, for example, PLT's 5 to 8 may be mentioned.

On the steel sheet used as the base material for the laminate film, in most cases, a chromate film obtained by electrolytic chromate treatment is being used. A chromate film has a two-layer structure of a metal Cr layer over which a hydrated Cr layer is formed.

The laminate film (if a film with a binder, the binder layer) secures the adhesion with the steel sheet and the wettability with the coating through the hydrated Cr layer of the chromate film. The mechanism of manifestation of this adhesion has not been clarified in detail, but is said to be a result of the hydrogen bonds of the hydroxyl groups of the hydrated Cr and the carbonyl groups of the laminate film or ester groups or other functional groups.

CITATION LIST

Patent Literature

PLT 1: Japanese Patent No. 1571783
PLT 2: Japanese Patent No. 1670957

PLT 3: Japanese Patent Publication (A) No. 2-263523
PLT 4: Japanese Patent No. 1601937
PLT 5: Japanese Patent Publication (A) No. 3-236954
PLT 6: Japanese Patent Publication (A) No. 05-124648
PLT 7: Japanese Patent Publication (A) No. 5-111979
PLT 8: Japanese Patent Publication (A) No. 5-147181
PLT 9: Japanese Patent Publication (A) No. 2006-9047
PLT 10: Japanese Patent Publication (A) No. 2005-325402

SUMMARY OF INVENTION

Technical Problem

According to the above inventions, the advantageous effect of protection of the global environment is obtained.

On the other hand, in recent years, in the beverage container market, the competition over cost and quality in PET bottles, glass bottles, paper, and other materials has intensified. For steel sheet for laminated container use as well, excellent adhesion and corrosion resistance are sought to be secured, then better canmaking ability, in particular, film adhesion, worked film adhesion, corrosion resistance, etc. are sought.

Further, in recent years, due to the limits on use of lead, cadmium, and other toxic substances and considerations regarding the working environment in production plants, a film which does not use chromate and does not detract from the canmaking ability has been sought.

The present invention was made based on this situation and has as its object the provision of steel sheet for container use which has excellent canmaking ability and which has excellent drawability and ironability, weldability, corrosion resistance, coating adhesion, wettability, and film adhesion and a method of production of the same.

Solution to Problem

The inventors proposed in PLT 9 and PLT 10 the use of a Zr compound film as a new film to take the place of chromate film.

If using these arts, it is possible to obtain a film having a certain performance. However, the wettability by the coating was not sufficient.

The inventors engaged in in-depth studies and as a result discovered that by forming on the steel sheet, by electrolysis or dipping, a Zr compound film or a composite Zr film of a Zr compound film with a phosphate film or other Zr film, then cleaning by hot water, it is possible to strikingly improve the wettability by the coating and that, further, extremely powerful covalent bonds are formed with the coating and laminate film, excellent canmaking ability equal to or better than that of chromate films is obtained, and excellent drawability and ironability, weldability, corrosion resistance, coating adhesion, and film adhesion are also obtained.

The present invention was made by studies based on the above discovery and has as its gist the following.

(1) A steel sheet for container use with excellent primary adhesion of film and primary coating adhesion comprising a Zr film on the surface of the steel sheet, wherein the Zr film contains, by amount of metal Zr, 1 to 100 mg/m$^2$ of a Zr oxide.

(2) The steel sheet for container use with excellent primary adhesion of film and primary coating adhesion as set forth in (1) wherein the Zr film further contains, by amount of P, 0.1 to 50 mg/m$^2$ of a Zr phosphate compound (3) The steel sheet for container use with excellent primary adhesion of film and primary coating adhesion as set forth in (1) or (2) wherein the steel sheet is a surface-treated steel sheet having, on one or both surfaces, a surface-treated layer containing at least one of Ni: 10 to 1000 mg/m$^2$ and Sn: 100 to 15000 mg/m$^2$.

(4) The steel sheet for container use with excellent primary adhesion of film and primary coating adhesion as set forth in (1) or (2), wherein when coating the steel sheet for container use with an epoxy phenol resin, then baking the steel sheet at 200° C. for 30 minutes, next cross-cutting the surface of the steel sheet to a depth reaching the base iron at 1 mm intervals, further treating the steel sheet by retort treatment at 125° C. for 30 minutes, then drying the steel sheet, then attaching and closely adhering adhesive tape to the cross-cuts, then peeling off that adhesive tape, the pieces of the cross-cuts from which the coating was peeled off are less than 1% of the total pieces.

(5) The steel sheet for container use with excellent primary adhesion of film and primary coating adhesion as set forth in (3) wherein when coating the steel sheet for container use with an epoxy phenol resin, then baking the steel sheet at 200° C. for 30 minutes, next cross-cutting the surface of the steel sheet to a depth reaching the base iron at 1 mm intervals, further treating the steel sheet by retort treatment at 125° C. for 30 minutes, then drying the steel sheet, then attaching and closely adhering adhesive tape to the cross-cuts, then peeling off that adhesive tape, the pieces of the cross-cuts from which the coating was peeled off are less than 1% of the total pieces.

(6) The steel sheet for container use with excellent primary adhesion of film and primary coating adhesion as set forth in (1) or (2) wherein after immersing the steel sheet for container use in 1 liter of 70° C. distilled water and stirring for 30 minutes, a concentration of nitrate ions which are eluted into the solution is 5 mass ppm or less per Zr film 1 m$^2$.

(7) The steel sheet for container use with excellent primary adhesion of film and primary coating adhesion as set forth in (3) wherein after immersing the steel sheet for container use in 1 liter of 70° C. distilled water and stirring for 30 minutes, a concentration of nitrate ions which are eluted into the solution is 5 mass ppm or less per Zr film 1 m$^2$.

(8) The steel sheet for container use with excellent primary adhesion of film and primary coating adhesion as set forth in (1) or (2) wherein a surface wetting tension is 31 mN/m or more.

(9) The steel sheet for container use with excellent primary adhesion of film and primary coating adhesion as set forth in (3) wherein a surface wetting tension is 31 mN/m or more.

(10) A method of production of the steel sheet for container use with excellent primary adhesion of film and primary coating adhesion as set forth in (1) or (2) comprising the steps of:

using a solution containing Zr ions, ammonium ions, and nitrate ions and, furthermore, as required, containing phosphate ions for dipping or electrolytic treatment to form a Zr film on the steel sheet;

rinsing;

cleaning the Zr film by 40° C. or more hot water for 0.5 second or more.

(11) A method of production of the steel sheet for container use with excellent primary adhesion of film and primary coating adhesion as set forth in (3) comprising the steps of:

using a solution containing Zr ions, ammonium ions, and nitrate ions and, furthermore, as required, containing phosphate ions for dipping or electrolytic treatment to form a Zr film on the steel sheet;

rinsing;

cleaning the Zr film by 40° C. or more hot water for 0.5 second or more.

Advantageous Effects of Invention

According to the present invention, it is possible to obtain steel sheet for container use with excellent drawability and ironability, weldability, corrosion resistance, coating adhesion, and film adhesion. The steel sheet for container use according to the present invention can also be used as steel sheet for laminated container use with excellent canmaking ability.

DESCRIPTION OF EMBODIMENTS

Below, the present invention will be explained in detail.

The sheet material used for the steel sheet for container use of the present invention is not particularly limited. Steel sheet which is usually used as a material for containers may be used.

The method of production, quality, etc. of the sheet material are not particularly limited. The sheet may be produced through the usual processes from the process of production of steel slabs such as hot rolling, pickling, cold rolling, annealing, and temper rolling.

The Zr film of the present invention is imparted to the steel sheet or to the later explained surface-treated layer. The methods of imparting the Zr film include, for example, the method of dipping the steel sheet in an acidic solution in which Zr ions and phosphate ions are dissolved, the method of using cathodic electrolysis, etc.

The method of using dipping etches the base material to form various types of films, so the deposition becomes uneven. Further, the treatment type also becomes long, so this is disadvantageous industrially.

According to cathodic electrolysis, a uniform film can be obtained by the surface cleaning due to the forced charge transfer and generation of hydrogen at the steel sheet interface and by the effect of promotion of deposition due to the rise in pH.

Further, in the treatment solution, nitrate ions and ammonium ions are copresent, so treatment in a short time of several seconds to several tens of seconds becomes possible. Furthermore, it is possible to promote the deposition of a Zr film containing Zr oxides and Zr phosphates excellent in effect of improvement of the corrosion resistance and adhesion. Accordingly, the method using cathodic electrolysis is extremely advantageous industrially.

Therefore, according to the present invention, it is preferable to impart the Zr film by cathodic electrolysis, more preferably by cathodic electrolysis by a treatment solution in which nitrate ions and ammonium ions are copresent.

The role of the Zr film is to secure the corrosion resistance and adhesion. A Zr film includes Zr hydrates comprised of Zr oxide and Zr hydroxide and may further contain Zr phosphates.

If the Zr film increases, the corrosion resistance and the adhesion are improved. If, by amount of metal Zr, becoming 1 mg/m$^2$ or more, a corrosion resistance and adhesion of a level not posing any problems in practice are secured.

If the amount of the Zr film increases, the effect of improvement of the corrosion resistance and adhesion also increases. However, if the amount of Zr film exceeds, by amount of metal Zr, 100 mg/m$^2$, the Zr film becomes too thick, the adhesion of the Zr film itself deteriorates, and the electrical resistance rises and the weldability deteriorates.

Therefore, in the present invention, the amount of deposition of the Zr film is made, by amount of metal Zr, 1 to 100 mg/m$^2$.

Further, if the Zr phosphates increase, a better corrosion resistance and adhesion are obtained. To obtain this effect, the amount of the phosphate film is preferably, by amount of P, 0.1 $mg/m^2$ or more.

If the amount of the phosphate film increases, the effect of improvement of the corrosion resistance and adhesion also becomes greater. However, if the amount of the phosphate film exceeds, by amount of P, 50 $mg/m^2$, the phosphate film becomes too thick, the adhesion of the phosphate film itself deteriorates, and the electrical resistance rises and the weldability deteriorates.

Therefore, the amount of deposition of the phosphate film is preferably, by amount of P, 0.1 to 50 $mg/m^2$.

The amount of the metal Zr and the amount of the P which are contained in the Zr film can, for example, be measured by fluorescent x-ray analysis or other quantitative analysis methods.

The sheet material may also be given a surface-treated layer including at least one of Ni and Sn. The method of imparting the surface-treated layer is not particularly limited. For example, electroplating, vacuum deposition, sputtering, or other known arts may be used. To impart a diffusion layer, it is also possible to perform heat treatment after plating.

Further, even if applying Fe—Ni alloy plating as the surface-treated layer containing Ni, the gist of the present invention is unchanged.

The surface-treated layer preferably contains Ni in an amount, as metal Ni, of 10 to 1000 $mg/m^2$ in range.

Ni improves the coating adhesion, film adhesion, corrosion resistance, and weldability. To obtain these effects, it is preferable to impart, as metal Ni, 10 $mg/m^2$ or more of Ni. Along with the increase in the amount of deposition of Ni, the effect of improvement of the coating adhesion, film adhesion, corrosion resistance, and weldability increases.

However, if the amount of deposition of Ni becomes 1000 $mg/m^2$ or more, the effect becomes saturated and the result becomes disadvantageous economically.

The surface-treated layer preferably contains Sn in an amount, as metal Sn, of 100 to 15000 $mg/m^2$ in range.

Sn improves the workability, weldability, and corrosion resistance. To obtain this effect, it is preferable to impart, as metal Sn, 100 $mg/m^2$ or more of Sn. To obtain sufficient weldability, 200 $mg/m^2$ or more of Sn is preferably imparted. To obtain sufficient workability, 1000 $mg/m^2$ or more of Sn is preferably imparted. Along with the increase in the amount of deposition of Sn, the effect of improvement of the workability, weldability, and corrosion resistance increases.

However, if the amount of deposition of Sn becomes 15000 $mg/m^2$ or more, the effect of improvement of the corrosion resistance becomes saturated and the result becomes disadvantageous economically.

If performing reflowing after the Sn plating, an Sn alloy layer is formed and the corrosion resistance can be improved much more.

The amount of metal Ni and the amount of metal Sn in the surface-treated layer can, for example, by measured by the fluorescent x-ray method.

In this case, samples of known amounts of metal Ni are used to prepare a calibration line showing the relationship between the values obtained as a result of measurement and the amount of metal Ni. This calibration line is used to identify the amount of metal Ni on a relative basis.

In the case of the amount of metal Sn, in the same way, samples of known amounts of metal Sn are used to prepare a calibration line showing the relationship between the values obtained as a result of measurement and the amount of metal Sn. This calibration line is used to identify the amount of metal Sn on a relative basis.

In the present invention, to form a Zr film, a treatment solution containing Zr nitrates is preferably used, while to promote the precipitation of the Zr film, a treatment solution in which nitrate ions and ammonium ions are copresent is preferably used. At this time, since the nitrate ions are contained in the treatment solution, they are sometimes taken into the Zr film along with the Zr compounds.

The present invention has as its object the provision of steel sheet for container use which is free of problems such as coating cissing. As an important characteristic for judging that the problems of coating cissing etc. do not occur, there is the surface wetting tension of the Zr film.

If nitrate ions remain in the Zr film, since nitrate ions have hydrophilicity, the apparent surface wetting tension is measured large. That is, it is no longer possible to accurately measure the surface wetting tension, an important characteristic in the present invention, so this is not preferred.

Furthermore, the nitrate ions in the film do not have an effect on the normal adhesion (primary adhesion) of the coating or film, but become a cause of deterioration of the adhesion at the time of retort treatment or other high temperature sterilizing treatment or other high temperature treatment including steam (secondary adhesion), rustproofness, and underfilm corrosion.

This is believed caused by the nitrate ions which remain in the film being eluted into the steam or corrosive solution, breaking bonds with the organic film, and promoting corrosion of the base material steel sheet.

Therefore, the steel sheet for container use of the present invention preferably has a concentration of nitrate ions eluted into a solution, after being immersed in 1 liter of 70° C. distilled water and stirred for 30 minutes, of 5 mass ppm or less per Zr film 1 $m^2$. If the concentration of eluted nitrate ions exceeds 5 mass ppm, the deterioration of the secondary adhesion, rustproofness, and underfilm corrosion starts to become pronounced. More preferably, the concentration of nitrate ions eluted into the solution is 3 mass ppm or less, more preferably 1 mass ppm or less. No elution at all (0 ppm) is most preferable.

The concentration of nitrate ions eluted from the Zr film can, for example, be measured by quantitative analysis using ion chromatography.

To obtain a sufficient wettability, the surface wetting tension is preferably 31 mN/m or more. 35 mN/m or more is more preferable.

The "surface wetting tension" referred to here is the value measured by the method prescribed in JIS K 6768. In this standard, test solutions prepared to various surface tensions are coated and the surface wetting tensions are measured in the wetted state by the test solutions. If the wetted state by a test solution with a high surface tension is good, it means the surface wetting tension is high and the wettability is also excellent.

The steel sheet or the surface-treated layer is formed with the Zr film, then rinsed, then cleaned by hot water. The purpose of the cleaning by hot water is to improve the cleanliness and wettability by the treatment solution.

Improvement of the wettability suppresses pinholes due to coating cissing and contributes to improvement of the quality of the coated steel sheet. Hot water cleaning is usually performed immediately after formation of the Zr film.

The details of the mechanism by which hot water cleaning improves the wettability are unclear, but it is believed that a mechanism like an increase in the hydrophilic functional groups at the outermost layer of the film is in play. To obtain this effect, cleaning by 40° C. or more, preferably 55° C. or more hot water for 0.5 second or more is preferable. The cleaning is, for example, performed by dipping, spraying, etc. Industrially, spraying, from which a cleaning promoting effect can be expected due to the fluid motion of the solution, or composite treatment by dipping and spraying is preferable.

Examples

Below, examples of the present invention will be explained.

<Surface-Treated Layer on Steel Sheet>

Any of the following methods of the (Treatment Method 1) to (Treatment Method 7) was used to impart a surface-treated layer to 0.17 to 0.23 mm thick steel sheet (in Treatment Method 1, no surface-treated layer imparted).

(Treatment Method 1) A cold rolled, then annealed and tempered sheet material was degreased and pickled to prepare steel sheet.

(Treatment Method 2) A cold rolled, then annealed and tempered sheet material was degreased, pickled, then plated with Sn using a Ferrostan bath to prepare Sn-plated steel sheet.

(Treatment Method 3) A cold rolled, then annealed and tempered sheet material was degreased, pickled, then plated with Ni using a Watt bath to prepare Ni-plated steel sheet.

(Treatment Method 4) A cold rolled sheet material was plated with Ni using a Watt bath and was formed with an Ni diffusion layer at the time of annealing to prepare Ni-plated steel sheet.

(Treatment Method 5) A cold rolled, then annealed and tempered sheet material was degreased, pickled, then plated with Sn using a Ferrostan bath, then subjected to reflow treatment to prepare Sn-plated steel sheet having an Sn alloy layer.

(Treatment Method 6) A cold rolled, then annealed and tempered sheet material was degreased, pickled, then plated with an Fe—Ni alloy using a sulfuric acid-hydrochloric acid bath, then plated with Sn using a Ferrostan bath to prepare Ni- and Sn-plated steel sheet.

(Treatment Method 7) A cold rolled, then annealed and tempered sheet material was degreased, pickled, then plated with an Sn—Ni alloy using a sulfuric acid-hydrochloric acid bath to prepare Ni- and Sn-plated steel sheet.

<Film Formation>

After the above treatment, any of the following methods of the (Treatment Method 8) to (Treatment Method 11) was used to form a Zr film.

(Treatment Method 8) The above steel sheet was immersed in a treatment solution in which 1000 ppm of Zr nitrate and 1500 ppm of ammonium nitrate were dissolved and was cathodically electrolyzed to form a Zr film.

(Treatment Method 9) The above steel sheet was immersed in a treatment solution in which 2000 ppm of Zr nitrate, 500 ppm of phosphoric acid, and 1500 ppm of ammonium nitrate were dissolved and was cathodically electrolyzed to form a Zr film.

(Treatment Method 10) The above steel sheet was immersed in a treatment solution in which 1000 ppm of Zr nitrate and 1500 ppm of ammonium nitrate were dissolved to form a Zr film.

(Treatment Method 11) The above steel sheet was immersed in a treatment solution in which 2000 ppm of Zr nitrate and 1500 ppm of ammonium nitrate were dissolved to form a Zr film.

<Rinsing Treatment>

After forming the Zr film by the above treatment, the sheet was rinsed at the temperature and time shown in Table 2.

In the present example, the amount of metal Ni and the amount of metal Sn in the surface-treated layer were measured by the fluorescent x-ray method and identified using calibration lines. The amount of metal Zr and the amount of P contained in the Zr film were measured by fluorescent x-ray analysis or another quantitative analysis method.

The amount of elution of nitrate ions from the chemically converted film after rinsing was identified by the following method:

The above treated steel sheet was cut into 50 mm×100 mm pieces to prepare samples. The sheared edges were not masked and no degreasing treatment was performed.

A 2 liter volume separable flask able to be equipped with a water-cooling reflux tube was charged with about 900 ml of distilled water which was then heated to a boil on an electric heater. After confirming boiling, 10 samples were set on a glass sample rack and immersed into the boiling water.

The samples were water-cooled and refluxed so as to be completely immersed (if necessary, adding distilled water) to extract, while stirring, nitrate ions over 30 minutes.

Then, the solution deposited on the samples was washed off by distilled water. This was added to the above extracted solution which was then brought to a boil. Ten new samples were set on a new glass sample rack and inserted.

A similar extraction operation was performed repeatedly five times to extract nitrate ions from a total of 50 samples (total area of 0.5 $m^2$).

After the end of the extraction work, the entire amount of the distilled water in which nitrate ions were extracted was diluted by distilled water to 1 liter to obtain a test solution. The concentration of the nitrate ions in the test solution was identified by liquid ion chromatography and converted into a value per 1 $m^2$. The measurement conditions of the liquid ion chromatography were as shown in Table 1.

TABLE 1

| | |
|---|---|
| Apparatus | Shimadzu Personal Ion Analyzer PIO-1000 |
| Type of column | Shim-pack IC-A3(S) (2.0 mm ID × 150 mmL) |
| Mobile phase | IC-MA3-1 (PIA Anion MA3-1) |
| Flow rate | 0.25 ml/min |
| Measurement temperature | 35° C. |
| Detector | Electroconductivity |
| Injected amount | 20 μl |
| Dilution rate | 1 |
| Pretreatment | Filtering (5C) |

<Evaluation of Performance>

Test materials treated in the above way were evaluated for performance in terms of the items of (A) to (H) shown below.

(A) Workability

At the two sides of the test sample, 20 μm thick PET films were laminated at 200° C. The sample was subjected to a canmaking process comprised of drawing and ironing in stages. The shaping was evaluated in four stages (A: extremely good, B: good, C: defects observed, D: broke and could not be worked). A workability of B or more was deemed passing.

(B) Weldability

A wire seam welder was used to weld a test material under conditions of a welding wire speed of 80 m/min while changing the current. The weldability was judged from the extent of the suitable current range comprised of the minimum current value giving a sufficient welding strength and the maximum current value where dust and weld spatter and other welding defects start to become noticeable and was evaluated in 4 stages (A: extremely good, B: good, C: poor, D: welding impossible). A weldability of B or more was deemed passing.

(C) Film Adhesion

At the two sides of the test sample, 20 μm thick PET films were laminated at 200° C. The sample was drawn and ironed to prepare a can body which was then subjected to retort treatment at 125° C. for 30 minutes. The adhesion was evaluated from the peeled off area of the film in four stages (A: peeled off area 0%, B: peeled off area 5% or less, C: peeled off area over 5% to 20%, D: peeled off area over 20%). A film adhesion of B or more was deemed passing.

(D) Primary Coating Adhesion

The test material was coated with an epoxy phenol resin, baked at 200° C. for 30 minutes, then was cross-cut to a depth reaching the base iron at 1 mm intervals, then was stuck with adhesive tape over the cross cuts. The tape was then peeled off and the state of adhesion was evaluated from the peeled off area of the film in four stages (A: peeled off area 0%, B: peeled off area 5% or less, C: peeled off area over 5% to 20%, D: peeled off area over 20%). A primary coating adhesion of B or more was deemed passing.

(E) Secondary Coating Adhesion

The test material was coated with an epoxy phenol resin, baked at 200° C. for 30 minutes, then was cross-cut to a depth reaching the base iron at 1 mm intervals, then was subjected to retort treatment at 125° C. for 30 minutes, dried, then stuck with adhesive tape over the cross cuts. The tape was then peeled off and the state of adhesion was evaluated from the peeled off area of the film in four stages (A: peeled off area 0%, B: peeled off area 5% or less, C: peeled off area over 5% to 20%, D: peeled off area over 20%). A secondary coating adhesion of B or more was deemed passing.

(F) Underfilm Corrosion Resistance

The test material was coated with an epoxy phenol resin, baked at 200° C. for 30 minutes, then was cross-cut to a depth reaching the base iron. It was immersed in a test solution comprised of 1.5% citric acid-1.5% saline mixed solution at 45° C. for 72 hours, cleaned, dried, then stuck with adhesive tape over the cross cuts. The tape was then peeled off and the state of underfilm corrosion of the cross-cut part and the state of corrosion of the plate part were evaluated as four stages (A: no underfilm corrosion observed, B: slight underfilm corrosion of extent not posing practical problem observed, C: minor underfilm corrosion and slight corrosion of flat parts observed, D: severe underfilm corrosion and corrosion of flat parts observed). An underfilm corrosion resistance of B or more was deemed passing.

(G) Retort Rustproofness

The test material was treated by retort treatment at 125° C. for 30 minutes. The state of occurrence of rust was evaluated by four stages (A: no rusting at all, B: very small rusting of extent not a practical problem, C: slight rusting, and D: rusting of most part). A retort rustproofness of B or more Was deemed passing.

(H) Wettability

The test material was coated with a commercially available wetting tension test solution and evaluated by the tension of the test solution of the limit where the test solution started to be repelled. It was evaluated by the magnitude of the tension in three stages (A: 35 mN/m or more, B: 31 mN/m or more, C: 30 mN/m or more, and D: less than 30 mN/m). A wettability of B or more was deemed passing.

The treatment conditions of the test materials and the test results are shown in Table 2.

TABLE 2

| | | Base metal layer | | | Chemical conversion method | | | Hot water cleaning method | | Chemical conversion film | | |
|---|---|---|---|---|---|---|---|---|---|---|---|---|
| | No. | Treatment method | Sn am't (mg/m$^2$) | Ni am(t (mg/m$^2$) | Zr film-forming method | Treatment time (sec) | Current density (A/dm$^2$) | Temp. (° C.) | Time (sec) | Zr deposition (mg/m$^2$) | P deposition (mg/m$^2$) | Nitrate ion elution (ppm) |
| Inv. | 1 | 1 | — | — | 8 | 2 | 10 | 40 | 0.5 | 54 | — | 1.6 |
| ex. | 2 | 1 | — | — | 9 | 3 | 10 | 70 | 0.5 | 98 | 48 | 4.1 |
| | 3 | 2 | 2800 | — | 11 | 1 | — | 40 | 0.4 | 2 | 0.3 | <0.5 |
| | 4 | 2 | 8000 | 12 | 10 | 3 | — | 37 | 0.5 | 8 | — | <0.5 |
| | 5 | 3 | — | 640 | 8 | 1 | 2 | 40 | 0.5 | 8 | — | <0.5 |
| | 6 | 3 | — | 980 | 9 | 1.5 | 5 | 50 | 0.4 | 24 | 28 | 0.6 |
| | 7 | 4 | — | 450 | 11 | 8 | — | 40 | 0.5 | 15 | 24 | <0.5 |
| | 8 | 4 | — | 950 | 10 | 20 | — | 70 | 0.4 | 45 | — | 0.6 |
| | 9 | 5 | 13500 | — | 9 | 2 | 2 | 40 | 0.5 | 6 | 2 | <0.5 |
| | 10 | 5 | 7800 | 24 | 11 | 2 | — | 40 | 0.5 | 4 | 0.2 | <0.5 |
| | 11 | 6 | 1150 | 15 | 11 | 14 | — | 45 | 0.4 | 12 | 3 | <0.5 |
| | 12 | 6 | 750 | 80 | 8 | 2 | 4 | 40 | 0.5 | 24 | — | 0.5 |
| | 13 | 7 | 450 | 290 | 9 | 2.3 | 3 | 70 | 1 | 22 | 11 | <0.5 |
| | 14 | 7 | 950 | 120 | 11 | 2 | — | 40 | 0.5 | 4 | 1 | <0.5 |
| | 15 | 4 | — | 970 | 10 | 10 | — | 40 | 0.5 | 24 | — | <0.5 |
| | 16 | 1 | — | — | 9 | 14 | 5 | 40 | 0.5 | 80 | 4 | 2.6 |
| | 17 | 2 | 88 | — | 9 | 2 | 2 | 40 | 0.5 | 12 | 18 | <0.5 |
| | 18 | 3 | 0 | 640 | 9 | 4 | 8 | 40 | 0.6 | 28 | 78 | <0.5 |
| Comp. | 1 | 1 | — | — | 8 | 0.1 | 1 | 20 | 0.5 | 0.8 | — | <0.5 |
| ex. | 2 | 2 | 540 | — | 9 | 2.2 | 4 | 35 | 0.4 | 10 | — | <0.5 |
| | 3 | 2 | 71 | — | 9 | 4 | 10 | 20 | 0.5 | 120 | 88 | 8 |
| | 4 | 6 | 1050 | 22 | 10 | 10 | 1 | 35 | 0.5 | 54 | — | 6 |
| | 5 | 3 | — | 8 | 11 | 0.2 | — | 40 | 0.1 | 0.5 | 0.07 | <0.5 |

TABLE 2-continued

| | | Evaluation | | | | | | | |
|---|---|---|---|---|---|---|---|---|---|
| | | Work- | Weld- | Film | Coating adhesion | | Under-film | Retort rust- | |
| | No. | ability | ability | adhesion | Primary | Secondary | corrosion | proofness | wettability |
| Inv. | 1 | A | B | B | B | B | B | B | A |
| ex. | 2 | A | B | A to B | A to B | B | B | B | A |
| | 3 | A | A | A | A | A | A | A to B | B |
| | 4 | A | A | A to B | A to B | A to B | A to B | A | A |
| | 5 | A | A | A to B | A to B | A to B | A to B | A to B | A |
| | 6 | A | A | A | A | A | A | A to B | A |
| | 7 | A | A | A | A | A | A | A to B | A |
| | 8 | A | A | A to B | A to B | A to B | A to B | A | A |
| | 9 | A | A | A | A | A | A | A to B | A |
| | 10 | A | A | A to B | A to B | A to B | A to B | A | A |
| | 11 | A | A | A | A | A | A | A to B | A |
| | 12 | A | A | A to B | A to B | A to B | A to B | A to B | A |
| | 13 | A | A | A | A | A | A | A to B | A |
| | 14 | A | A | A | A | A | A | A to B | A |
| | 15 | A | A | A to B | A to B | A to B | A to B | A | A |
| | 16 | B | B | B | B | B | B | B | A |
| | 17 | B | B | B | B | B | B | B | A |
| | 18 | A | B | A to B | A to B | A to B | A to B | A | A |
| Comp. | 1 | B to C | B | D | D | D | D | D | D |
| ex. | 2 | A | A | D | B | C to D | D | B | C |
| | 3 | C | C to D | D | B | D | D | D | A to B |
| | 4 | A | A | D | B | D | D | C | A to B |
| | 5 | C | D | D | D | D | D | D | D |

Invention Examples 1 to 18 according to the present invention were all excellent in workability, weldability, film adhesion, primary coating adhesion, secondary coating adhesion, underfilm corrosion, rustproofness, and wettability.

Comparative Examples 1 to 4, each of which failed to satisfy at least one of the requirements of the present invention, were poor in at least part of the characteristics of workability, weldability, film adhesion, primary coating adhesion, secondary coating adhesion, underfilm corrosion, rustproofness, and wettability.

In particular, Comparative Examples 3 and 4 had nitrate ions remaining in the Zr film of over 5 ppm, so the apparent wettability was excellent, but it was learned that the film adhesion and coating adhesion (secondary) were not sufficient for retort treatment.

INDUSTRIAL APPLICABILITY

According to the present invention, it is possible to obtain steel sheet for container use with excellent drawability and ironability, weldability, corrosion resistance, coating adhesion, and film adhesion. This can be utilized as steel sheet for laminated container use with excellent canmaking ability, so the contribution to the ferrous metal industry and canmaking industry is great and the industrial applicability is large.

The invention claimed is:

1. A steel sheet for container use comprising a Zr film directly formed on one or both surfaces of the steel sheet, wherein the Zr film consists of a Zr oxide and a Zr hydroxide; a Zr oxide, a Zr hydroxide and a Zr phosphate; or a Zr oxide and a Zr phosphate, and wherein the Zr film has, by amount of metal Zr, 1 to 100 $mg/m^2$.

2. The steel sheet for container use as set forth in claim 1, wherein the Zr film has, by amount of P, 0.1 to 50 $mg/m^2$ of the Zr phosphate.

3. The steel sheet for container use as set forth in claim 1 or 2, wherein when coating the steel sheet for container use with an epoxy phenol resin for the purpose of testing, then baking the steel sheet at 200° C. for 30 minutes, next cross-cutting the surface of the steel sheet to a depth reaching the base iron at 1 mm intervals, further treating the steel sheet by retort treatment at 125° C. for 30 minutes, then drying the steel sheet, then attaching and closely adhering adhesive tape to the cross-cuts, then peeling off that adhesive tape, the pieces of the cross-cuts from which the coating was peeled off are less than 5% of the total pieces.

4. The steel sheet for container use as set forth in claim 1 or 2 wherein a surface wetting tension is 31 mN/m or more.

5. A steel sheet for container use comprising a surface-treated layer on one or both surfaces of the steel sheet and a Zr film directly formed on the surface-treated layer, wherein the surface-treated layer consists of at least one of a metal Sn layer, a metal Ni layer or a Fe—Ni alloy plated layer, and wherein the surface-treated layer has at least one of Ni: 10 to 1000 $mg/m^2$ or Sn: 100 to 15000 $mg/m^2$, and wherein the Zr film consists of a Zr oxide and a Zr hydroxide; a Zr oxide, a Zr hydroxide and a Zr phosphate; or a Zr oxide and a Zr phosphate, and wherein the Zr film has, by amount of metal Zr, 1 to 100 $mg/m^2$.

6. The steel sheet for container use as set forth in claim 5, wherein the Zr film has, by amount of P, 0.1 to 50 $mg/m^2$ of the Zr phosphate.

7. The steel sheet for container use as set forth in claim 5 or 6 wherein a surface wetting tension is 31 mN/m or more.

8. The steel sheet for container use as set forth in claim 5 or 6 wherein when coating the steel sheet for container use with an epoxy phenol resin for the purpose of testing, then baking the steel sheet at 200° C. for 30 minutes, next cross-cutting the surface of the steel sheet to a depth reaching the base iron at 1 mm intervals, further treating the steel sheet by retort treatment at 125° C. for 30 minutes, then drying the steel sheet, then attaching and closely adhering adhesive tape to the cross-cuts, then peeling off that adhesive tape, the pieces of the cross-cuts from which the coating was peeled off are less than 5% of the total pieces.

9. A steel sheet for container use comprising a Zr film directly formed on one or both surfaces of the steel sheet, wherein the Zr film consists of a Zr oxide, a Zr hydroxide and nitrate ions; a Zr oxide, a Zr hydroxide, a Zr phosphate and nitrate ions; or a Zr oxide, a Zr phosphate and nitrate ions, wherein the Zr film has, by amount of metal Zr, 1 to 100 $mg/m^2$, and wherein after immersing the steel sheet for container use in 1 liter of 70° C. distilled water and stirring for 30 minutes, a concentration of the nitrate ions which are eluted into the solution is 5 mass ppm or less per 1 $m^2$ of Zr film.

10. The steel sheet for container use as set forth in claim 9, wherein the Zr film has, by amount of P, 0.1 to 50 $mg/m^2$ of the Zr phosphate.

11. A steel sheet for container use comprising a surface-treated layer on one or both surfaces of the steel sheet and a Zr film directly formed on the surface-treated layer, wherein the surface-treated layer consists of at least one of a metal Sn layer, a metal Ni layer or a Fe—Ni alloy plated layer, and wherein the surface-treated layer has at least one of Ni: 10 to 1000 $mg/m^2$ or Sn: 100 to 15000 $mg/m^2$, and wherein the Zr film consists of a Zr oxide and a Zr hydroxide; a Zr oxide, a Zr hydroxide and a Zr phosphate; or a Zr oxide and a Zr phosphate, wherein the Zr film has, by amount of metal Zr, 1 to 100 $mg/m^2$, and wherein after immersing the steel sheet for container use in 1 liter of 70° C. distilled water and stirring for 30 minutes, a concentration of nitrate ions which are eluted into the solution is 5 mass ppm or less per 1 $m^2$ of Zr film.

12. The steel sheet for container use as set forth in claim 11, wherein the Zr film has, by amount of P, 0.1 to 50 $mg/m^2$ of the Zr phosphate.

* * * * *